US007158005B2

(12) United States Patent
Pleskach et al.

(10) Patent No.: US 7,158,005 B2
(45) Date of Patent: Jan. 2, 2007

(54) EMBEDDED TOROIDAL INDUCTOR

(75) Inventors: Michael D. Pleskach, Orlando, FL (US); Andrew J. Thomson, Brandon, MS (US); Bayardo A. Payan, Palm Bay, FL (US); Terry Provo, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 45 days.

(21) Appl. No.: 11/055,154

(22) Filed: Feb. 10, 2005

(65) Prior Publication Data

US 2006/0176139 A1 Aug. 10, 2006

(51) Int. Cl.
*H01F 5/00* (2006.01)
*H01F 27/28* (2006.01)

(52) U.S. Cl. ..... 336/229; 336/200; 336/232; 29/602.1

(58) Field of Classification Search ..... 336/200, 336/223, 232, 229; 29/602.1
See application file for complete search history.

(56) References Cited

U.S. PATENT DOCUMENTS

| | | | | |
|---|---|---|---|---|
| 3,581,243 | A | 5/1971 | Alford | |
| 3,681,716 | A | 8/1972 | Chiron et al. | |
| 4,638,271 | A | 1/1987 | Jecko et al. | |
| 4,967,171 | A | 10/1990 | Ban et al. | |
| 5,576,680 | A * | 11/1996 | Ling | 336/200 |
| 5,714,112 | A | 2/1998 | Hazeyama et al. | |
| 5,781,091 | A | 7/1998 | Krone et al. | |
| 6,054,914 | A | 4/2000 | Abel et al. | |
| 6,198,374 | B1 | 3/2001 | Abel | |

FOREIGN PATENT DOCUMENTS

| | | |
|---|---|---|
| EP | 0 754 660 A1 | 1/1997 |
| EP | 1 089 374 A2 | 4/2001 |
| EP | 1 108 533 | 6/2001 |
| JP | 56-123102 | 9/1981 |
| JP | 05-211402 | 8/1983 |
| JP | 07-015218 | 1/1995 |
| JP | 08-154006 | 6/1996 |
| JP | 08 307117 | 11/1996 |
| JP | 10/190321 | 7/1998 |
| JP | 2000307362 | 11/2000 |
| WO | WO 01-01453 A2 | 1/2001 |

OTHER PUBLICATIONS

U.S. Appl. No. 10/810,952, filed Mar. 26, 2003, Pleskach et al.
U.S. Appl. No. 10/657,054, filed Sep. 5, 2003, Pleskach et al.

(Continued)

*Primary Examiner*—Anh Mai
(74) *Attorney, Agent, or Firm*—Sacco & Associates, PA; Robert J. Sacco

(57) ABSTRACT

A toroidal inductor, including a substrate (100), a toroidal core region (434) defined within the substrate, and a toroidal coil including a first plurality of turns formed about the toroidal core region and a second plurality of turns formed about the toroidal core region. The second plurality of turns can define a cross sectional area (440) greater than a cross sectional area (442) defined by the first plurality of turns. The substrate and the toroidal coil can be formed in a co-firing process to form an integral substrate structure with the toroidal coil at least partially embedded therein. The first and second plurality of turns can be disposed in alternating succession. The toroidal core region can be formed of a substrate material having a permeability greater than at least one other portion of the substrate.

34 Claims, 8 Drawing Sheets

OTHER PUBLICATIONS

Itoh, T.; et al: "Metamaterials Structures, Phenomena and Applications" IEEE Transactions on Microwave Theory and Techniques; Apr. 2005; [Online}Retrieved from the Internet: URL:www.mtt.org/publications/Transactions/CFP_Metamaterials.pdf>.

Kiziltas, G.; et al: "Metamaterial design via the density method" IEEE Antennas and Propagation Society Int'l Symposium 2002, vol. 1, Jun. 16, 2002 pp. 748-751, Piscataway.

Salahun, E.; et al: "Ferromagnetic composite-based and magnetically-tunable microwave devices" IEEE MTT-S Microwave Symposium Digest, vol. 2, Jun. 2, 2002 pp. 1185-1188.

* cited by examiner

EMBEDDED TOROIDAL INDUCTOR

BACKGROUND OF THE INVENTION

1. Statement of the Technical Field

The inventive arrangements relate generally to inductors and more particularly to toroidal inductors.

2. Description of the Related Art

As is well known, a magnetic field is generated each time an electric current is present in a conductor. An inductor is a passive electrical component that includes a series of conductive windings or coils (hereinafter "turns") which cooperate to define the magnetic field in a specified region when an electric current is established in the turns. The ability of an inductor to store energy in the magnetic field is described by an inductance L, which is generally proportional to the square of the number of turns $N^2$ and the permeability $\mu$ of the regions in which the magnetic field is established. The permeability $\mu$ oftentimes is discussed in terms of relative permeability $\mu_r$, which is the ratio of the permeability $\infty$ to the permeability of free space $\mu_0$. i.e.

$$\mu_r = \frac{\mu}{\mu_0}$$

Often times inductors are wound on ferromagnetic cores having a permeability which is greater than air (i.e. $\mu_r > 1.0$) in order to provide a greater inductance for a given number of turns. Such cores are available in a variety of shapes ranging from simple cylindrical rods to donut-shaped toroids. Toroids are known to provide certain advantages since, for a given permeability and number of turns, they provide a higher inductance as compared to solenoidal (rod-shaped) cores. Toroids also have the advantage of substantially containing the magnetic field produced by the inductor within the core region so as to limit RF leakage and minimize coupling and interference with other nearby components. For a typical toroidal inductor the inductance is given by the following equation:

$$L = \frac{\mu N^2 h}{2\pi} \ln \frac{b}{a}$$

in which h is a height of the inductor, a is an inner radius of the inductor, and b is an outer radius of the inductor.

In miniature RF circuitry, however, implementation of toroidal inductors is particularly difficult. Accordingly, inductors in miniature RF circuitry often tend to be implemented as surface mount components or as planar spirals formed directly on the surface of an RF substrate. Planar spiral inductors suffer from a serious drawback in that, in contrast to a toroidal inductor, they do not substantially contain the magnetic field that they produce. While surface mount toroidal inductors work well, the circuit board real estate required for such components is a significant factor contributing to the overall size of RF systems. Indeed, the use of passive surface mount devices oftentimes requires a circuit board to be larger than would otherwise be necessary to contain the circuit elements.

U.S. Pat. No. 5,781,091 to Krone, et al discloses an electronic inductive device and method for manufacturing same in a rigid copper clad epoxy laminate. The process involves drilling a series of spaced holes in an epoxy laminate, etching the copper cladding entirely off the board, positioning epoxy laminate over a second laminate, positioning a toroidal ferromagnetic core within each of the spaced holes, and filling the remainder of each hole with a fiber-filled epoxy. This technique involves numerous additional processing steps that are not normally part of the conventional steps involved in forming a conventional epoxy circuit board. These additional steps naturally involve further expense. Also, such techniques are poorly suited for use with other types of substrates, such as ceramic types described below.

Glass ceramic substrates calcined at 850~1,000C are commonly referred to as low-temperature co-fired ceramics (LTCC). This class of materials have a number of advantages that make them especially useful as substrates for RF systems. For example, low temperature 951 co-fire Green Tape™ from Dupont® is Au and Ag compatible, and it has a thermal coefficient of expansion (TCE) and relative strength that are suitable for many applications. Other LTCC ceramic tape products are available from Electro-Science Laboratories, Inc. of 416 East Church Road, King of Prussia, Pa. 19406-2625, USA. Manufacturers of LTCC products typically also offer metal pastes compatible with their LTCC products for defining metal traces and vias.

The process flow for traditional LTCC processing includes (1) cutting the green (unfired) ceramic tape from the roll, (2) removing the backing from the green tape, (3) punching holes for electrical vias, (4) filling via holes with conductor paste and screen printing patterned conductors, (5) stacking, aligning and laminating individual tape layers, (6) firing the stack to sinter powders and densify, and (7) sawing the fired ceramic into individual substrates.

LTCC processing requires that materials that are co-fired are compatible chemically and with regard to thermal coefficient of expansion (CTE). Typically, the range of commercially available LTCC materials have been fairly limited. For example, LTCC materials have been commercially available in only a limited range of permittivity values and have not generally included materials with relative permeability values greater than one. Recently, however, developments in metamaterials have begun to expand the possible range of materials that can be used with LTCC. Further, new high-permeability ceramic tape materials that are compatible with standard LTCC processes have become commercially available.

SUMMARY OF THE INVENTION

The invention relates to a toroidal inductor integrated within a substrate and a method of making same. The method can include forming in a substrate a first plurality of conductive vias radially spaced a first distance from a central axis so as to define a first inner circumference. A second plurality of conductive vias can be formed in the substrate radially spaced a second distance from the central axis so as to define a second inner circumference, the second distance greater than the first distance. A third plurality of conductive vias can be formed radially spaced a third distance from the central axis so as to define an outer circumference, the third distance greater than the second distance.

A first plurality of conductive traces can be disposed in a first plane defined orthogonal to the central axis, the first plurality of conductive traces forming an electrical connection between substantially radially adjacent ones of the first and third plurality of conductive vias. A second plurality of conductive traces can be disposed in the first plane, the second plurality of conductive traces forming an electrical connection between substantially radially adjacent ones of the second and third plurality of conductive vias. A third plurality of conductive traces can be disposed in a second plane spaced from the first plane and defined orthogonal to the central axis to define an electrical connection between circumferentially offset ones of the first and third plurality of conductive vias. Finally, a fourth plurality of conductive traces can be disposed in the second plane to define an electrical connection between circumferentially offset ones of the second and third plurality of conductive vias to define a three dimensional toroidal coil.

The method can include co-firing the substrate and the toroidal coil to form an integral substrate structure with the toroidal coil at least partially embedded therein. The method can further include forming at least a toroid shaped core region of the substrate, defined within the toroidal coil, of a material having at least one electrical characteristic different from at least one other portion of the substrate. For example, the material can be low-temperature co-fired ceramic (LTCC) which has a value of permeability which is higher than a material comprising other regions of the substrate. The substrate and the material in the toroid shaped core region can be co-fired together to form an integral substrate structure. The substrate also can be formed by stacking a plurality of substrate layers and selecting at least one of the substrate layers to have a relative permeability greater than one to be at least partially contained within a toroid shaped core region of the substrate defined within the toroidal coil.

In one arrangement the method can include forming in the substrate a fourth plurality of conductive vias radially spaced a fourth distance from the central axis so as to define a third inner circumference, the fourth distance less than the first distance. A fifth plurality of conductive traces can be disposed in the first plane, the fifth plurality of conductive traces forming an electrical connection between substantially radially adjacent ones of the fourth and third plurality of conductive vias. A sixth plurality of conductive traces can be disposed in the second plane to define an electrical connection between circumferentially offset ones of the fourth and third plurality of conductive vias.

The invention further concerns a printed circuit board, including a substrate, having a toroidal core region defined within the substrate and a toroidal coil. The toroidal coil can include a first plurality of turns formed about the toroidal core region and a second plurality of turns formed about the toroidal core region, the second plurality of turns defining a cross sectional area greater than a cross sectional area defined by the first plurality of turns.

The substrate and the toroidal coil can be formed in a co-firing process to form an integral substrate structure with the toroidal coil at least partially embedded therein. The first and second plurality of turns can be disposed in alternating succession and contained within the substrate at all points. The toroidal core region can be composed of a substrate material that has a permeability greater than a second substrate material of at least one other portion of the substrate. The toroidal coil can further include a third plurality of turns formed about the toroidal core region, the third plurality of turns defining a cross sectional area greater than a cross sectional area defined by the second plurality of turns.

The invention further concerns a toroidal inductor, including a substrate, a toroidal core region defined within the substrate, and a toroidal coil including a first plurality of turns formed about the toroidal core region and a second plurality of turns formed about the toroidal core region. The second plurality of turns can define a cross sectional area greater than a cross sectional area defined by the first plurality of turns. The substrate and the toroidal coil can be formed in a co-firing process to form an integral substrate structure with the toroidal coil at least partially embedded therein. The first and second plurality of turns can be disposed in alternating succession. The toroidal core region can be formed of a substrate material having a permeability greater than at least one other portion of the substrate. A third plurality of turns can be formed about the toroidal core region, the third plurality of turns defining a cross sectional area greater than the cross sectional area defined by the second plurality of turns.

DETAILED DESCRIPTION OF THE PREFERRED EMBODIMENTS

The invention relates to a toroidal inductor integrated within a substrate and a method of making same. As defined herein, a toroidal inductor is an inductor having windings that define a closed path to substantially contain flux generated by the inductor. As such, the region defined by the inductor windings is not limited to a donut-shape, but also can be disk-shaped, or have any other shape suitable for defining a closed path for substantially containing the magnetic flux generated by the inductor.

Figure 1:
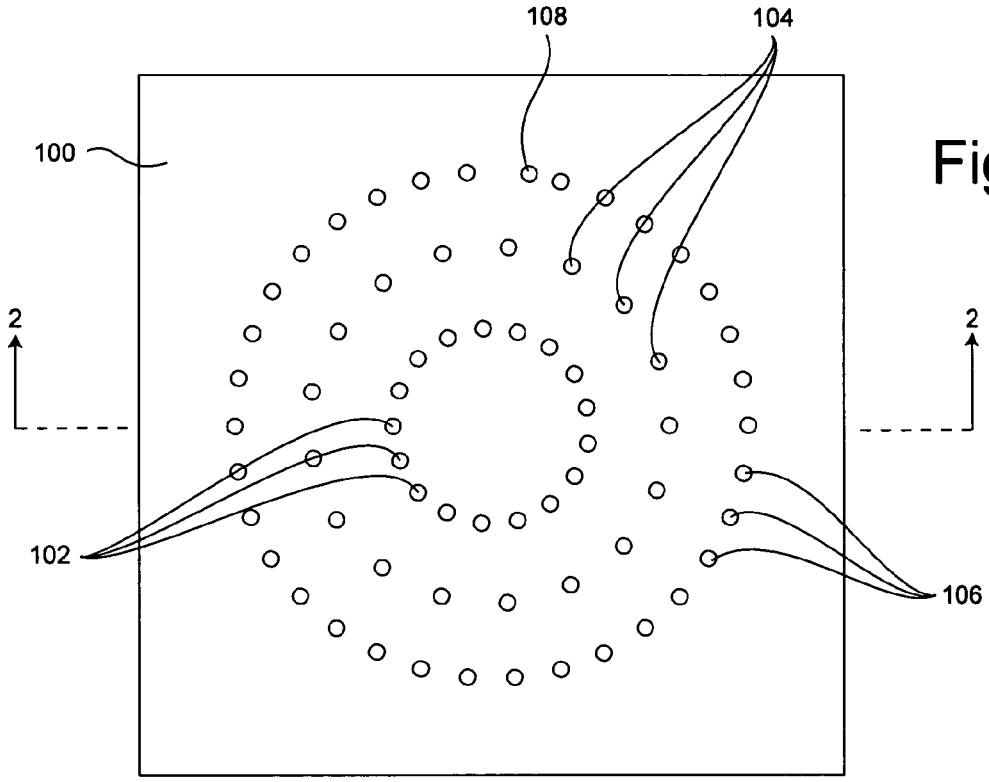
FIG. 1 a is top view of a ceramic substrate with vias formed therein that is useful for understanding the method of forming a toroidal inductor, the present invention.
Figure 2:
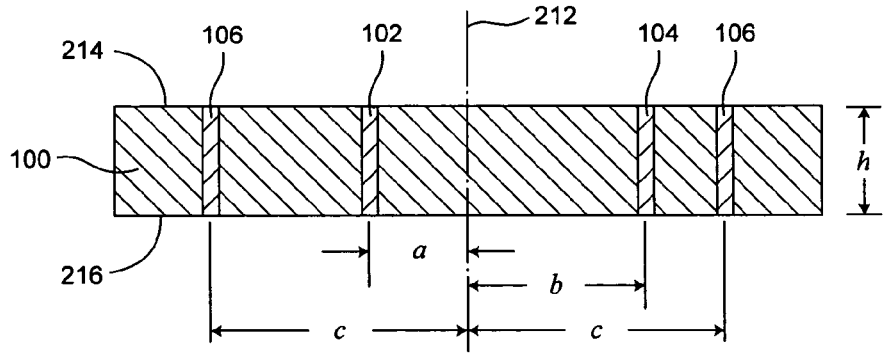
FIG. 2 is a cross-sectional view of the substrate of FIG. 1, taken along lines 2—2.
Figure 15:
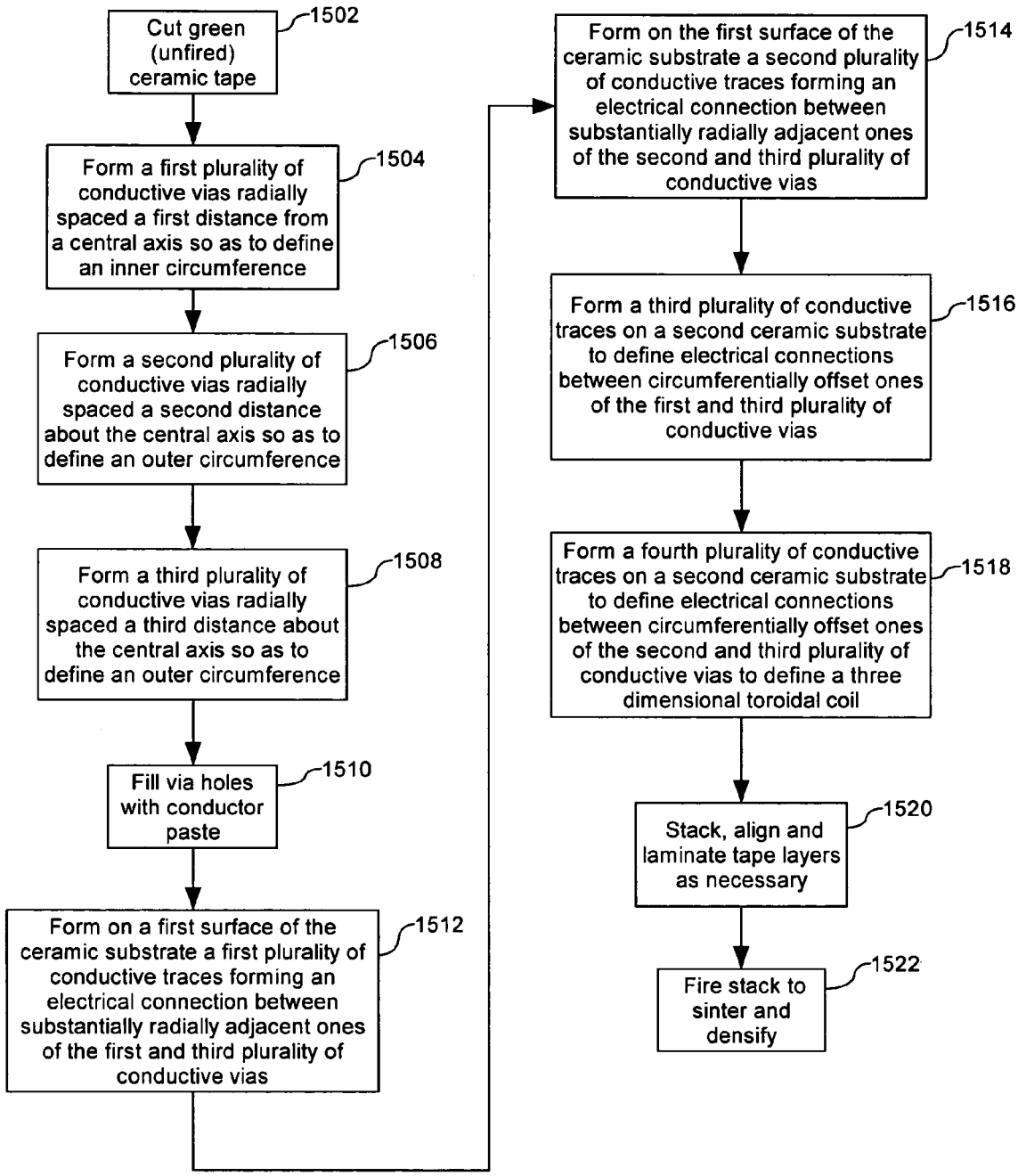
FIG. 15 is a flow chart that is useful for understanding the method of making the present invention.

The method shall be described in reference to FIGS. 1–2, and the flowchart in FIG. 15. The method can begin with step 1502 by forming a suitably sized substrate layer 100. The substrate layer 100 can be formed from any suitable substrate material and can include any number of sub-layers as appropriate to obtain a desired substrate thickness. For example, the substrate layer 100 can include one or more layers of unfired ceramic tape. The ceramic tape can be any of a variety of commercially available glass ceramic substrates. For instance, the ceramic tape can be a glass ceramic substrate designed to be calcined at 800° C. to 1,050° C. This class of materials is commonly referred to as low-temperature co-fired ceramics (LTCC). Such LTCC materials have a number of advantages that make them especially useful as substrates for RF systems. For example, low temperature 951 co-fire Green Tape™ from Dupont® is Au and Ag compatible, and it has a thermal coefficient of expansion (TCE) and relative strength that are suitable for many applications. Other similar types of ceramic tapes can also be used. The size of the ceramic tape can be determined by a variety of factors depending upon the particular application. For example, if the toroidal inductor is to form part of a larger RF circuit, the ceramic tape can be sized to accommodate the RF circuit in which the toroidal inductor forms a component.

A first plurality of conductive vias 102 can be formed in the substrate layer 100, as shown in step 1504. This step can be performed using any suitable technique. For example, vias can be formed by punching, laser cutting, or etching bores in the substrate layer 100. At step 1510 the bores can be filled with conductive paste and/or any other suitable conductive element.

As shown in FIGS. 1 and 2, the first plurality of conductive vias 102 can be radially spaced a first distance a from a central axis 212 so as to define an inner circumference of a toroidal inductor. In steps 1506 and 1510, a second plurality of conductive vias 104 can be similarly formed radially spaced a second distance b about the central axis so as to define an intermediate circumference. Likewise, in steps 1508 and 1510 a third plurality of conductive vias 106 can be formed radially spaced a third distance c about the central axis so as to define an outer circumference. As shown in FIG. 2, the vias can extend substantially between opposing surfaces 214, 216 of the substrate layer 100. One or more additional vias 108 can be provided to define a set of electrical contacts for the toroidal inductor.

In an arrangement in which the substrate layer 100 comprises a plurality of sub-layers, such as ceramic tape layers, steps 1504–1510 can be performed on each individual sub-layer. The respective conductive vias can be aligned and the sub-layers can be stacked to form the substrate layer 100 at step 1520. Further, it also should be appreciated that although steps 1504, 1506 and 1508 are separated in FIG. 15, such steps also can be performed in a single processing step. Similarly, steps 1512 and 1514 can be performed in a single processing step as well as steps 1516 and 1518.

Figure 3:
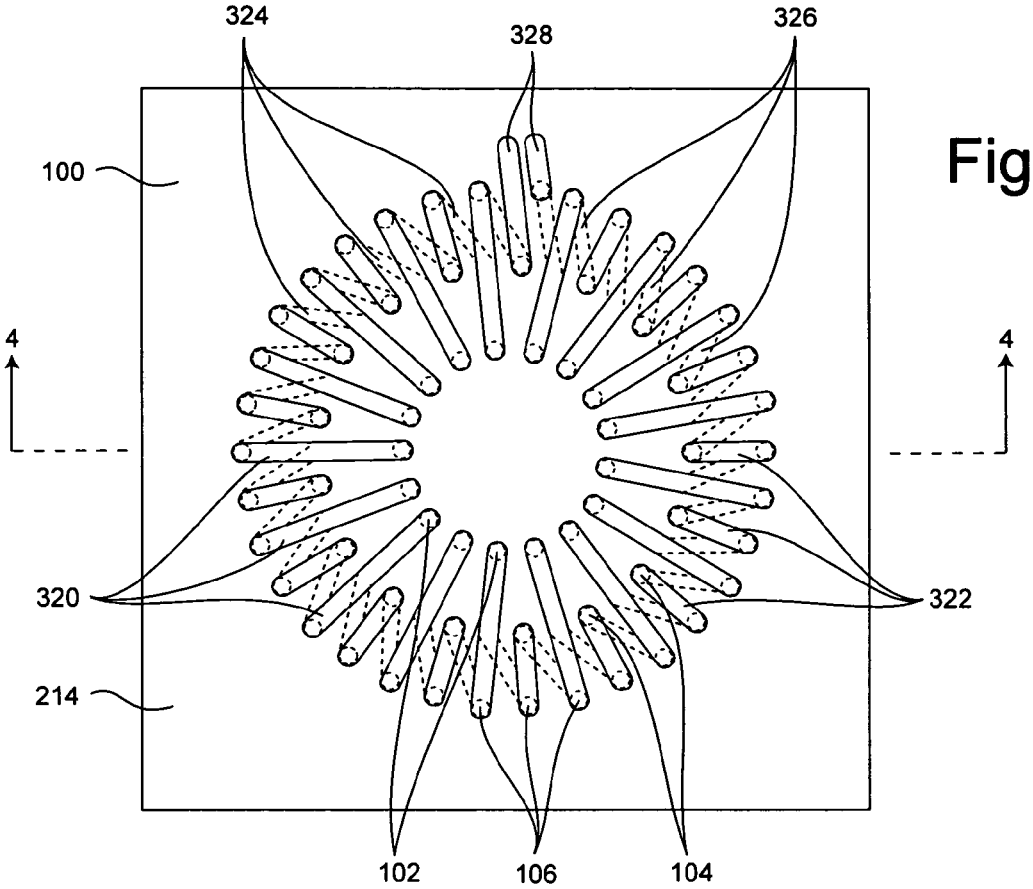
FIG. 3 is a top view of the substrate in FIG. 1, after conductive traces and a second layer has been added to form a toroidal inductor.
Figure 4:
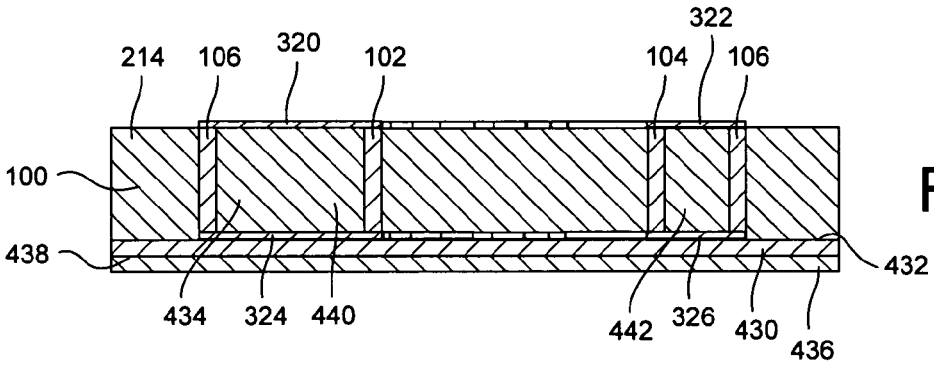
FIG. 4 is a cross-sectional view of the substrate in FIG. 3, taken along lines 4—4.

Referring now to FIGS. 3 and 4, the process can continue in steps 1512 and 1514 by disposing a first plurality of conductive traces 320 and a second plurality of conductive traces 322 on the substrate layer 100. The conductive traces 320 on surface 214 can form electrical connections between respective ones of the first and third plurality of conductive vias that are substantially radially adjacent. Similarly, the conductive traces 322 on surface 214 can form electrical connections between respective ones of the second and third plurality of conductive vias that are substantially radially adjacent.

In steps 1516 and 1518, a third plurality of conductive traces 324 and a fourth plurality of conductive traces 326 can be provided on surface 432 of a second substrate layer 430. The second substrate layer 430 also can be formed of any suitable substrate material, for instance LTCC. The third plurality of conductive traces 324 can be arranged so that when the two substrate layers are aligned and stacked as shown, the traces 324 on surface 432 will provide an electrical connection between circumferentially offset ones of the first plurality of conductive vias 102 and the third plurality of conductive vias 106. Similarly, the traces 326 on surface 432 can provide an electrical connection between circumferentially offset ones of the second plurality of conductive vias 104 and the third plurality of conductive vias 106. Additionally, traces 328 which contact the vias 108 can be provided to define the set of electrical contacts for the toroidal inductor.

The conductive traces 320, 322, 324, 326, 328 can be formed of any suitable conductive paste or ink that is compatible with the co-firing process for the selected substrate material. Such materials are commercially available from a variety of sources. Further, it should be noted that although two layers of substrate layer 100 and 430 are shown in FIG. 4 with conductive traces disposed on one side of each tape only, the invention is not limited in this regard. Those skilled in the art will appreciate that it is possible for conductive traces 320, 322, 324, 326, 328 to instead be disposed on opposing sides of a single layer of substrate layer 100 and such alternative arrangements are intended to be within the scope of the invention.

It also should be noted that additional substrate layers (not shown) also can be stacked onto the surface 214 of the substrate layer 100 and/or onto a surface 438 of the second substrate layer 430. For example, the substrate layers 100 and 430 can be sandwiched between a plurality of additional substrate layers so that the conductive vias 102, 104, 106 and conductive traces 320, 322, 324, 326 are embedded within a final substrate structure. In step 1520, the various substrate layers can be stacked and aligned with one another utilizing conventional processing techniques.

Figure 5:
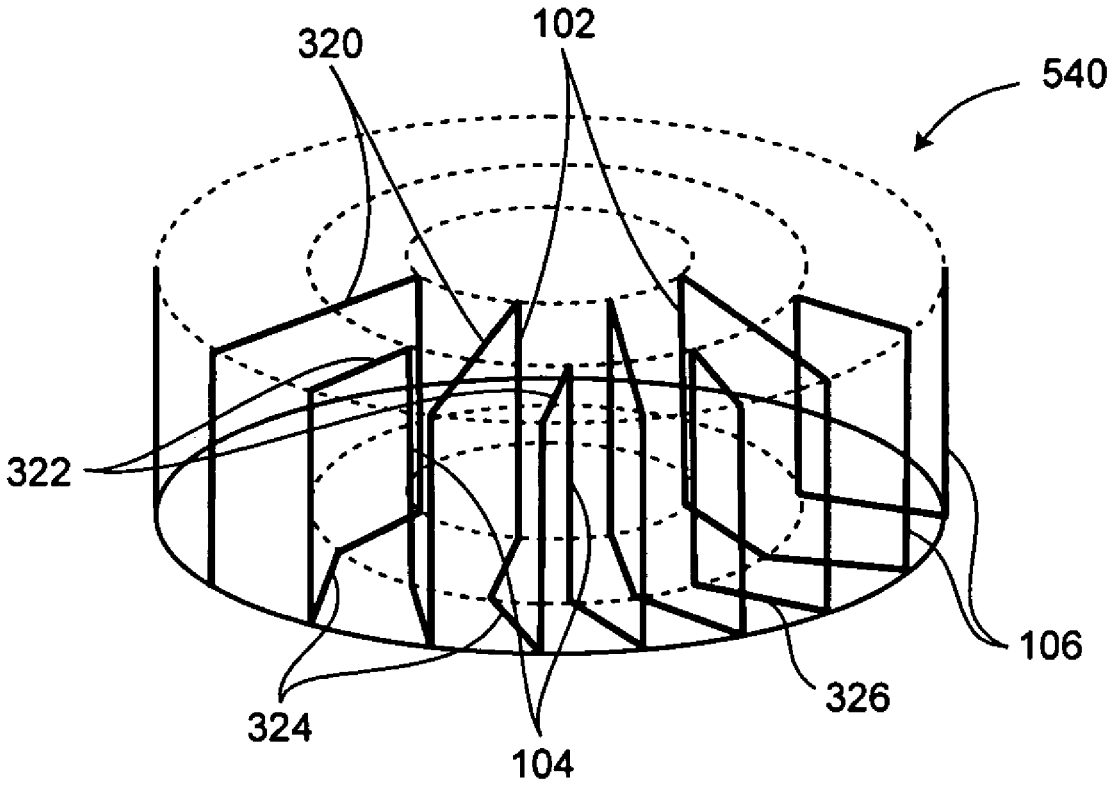
FIG. 5 is a schematic representation that is useful for understanding the structure of the toroidal inductor in FIGS. 1–4.

The conductive vias 102, 104, 106 and the conductive traces 320, 322, 324, 326 together define a three dimensional conductive toroidal coil 540, which is illustrated in FIG. 5. The toroidal coil is formed by the three-dimensional combination of the vias 102, 104, 106 and the conductive traces 320, 322, 324, 326, and is useful for understanding the toroidal coil structure resulting from the arrangement described relative to FIGS. 1–4. In this regard, it should be understood that the invention herein is not limited to the precise arrangement or pattern of vias 102, 104, 106 and traces 320, 322, 324, 326 that are illustrated in FIGS. 1–4. Instead, any pattern of vias and traces formed in the substrate layer can be used provided that it generally results in a substantially toroidal coil arrangement of the kind similar to that illustrated in FIG. 5, it being understood that many minor variations are possible.

For example, it is stated above that the conductive traces 320 on surface 214 form electrical connections between respective ones of the first and third plurality of conductive vias that are substantially radially adjacent. However, it should be noted that radially adjacent conductive vias, as that term is used herein, are not necessarily precisely aligned radially. Such radially adjacent vias can also include vias that are offset circumferentially from one another to some degree. Circumferentially offset vias are not aligned radially. Thus, it will be appreciated that the invention is not intended to be limited to any specific geometry of conductive traces 320, 322, 324, 326 and vias 102, 104, 106 provided that the combination of these elements define a continuous toroidal coil.

Once all of the vias 102, 104, 106, 108 and traces 320, 322, 324, 326, 328 are completed, the substrate layers 100 and 430, vias and traces can be fired together in step 1522 to sinter and densify the stack of substrate layers. The firing operation can be performed in accordance with a temperature and time appropriate for the particular type of substrate materials that are used.

As shown in FIGS. 1–4, the vias 102 can be densely spaced around the inner circumference of the toroidal inductor to maximize the number of conductive traces 320. Notably, the vias 104 and conductive traces 322 can be positioned between adjacent ones of conductive traces 320 without interfering with placement of the vias 102. This arrangement provides a greater number of turns for the toroidal inductor than would otherwise be attainable, thereby providing an increased level of inductance for the torroidal inductor.

Figure 6:
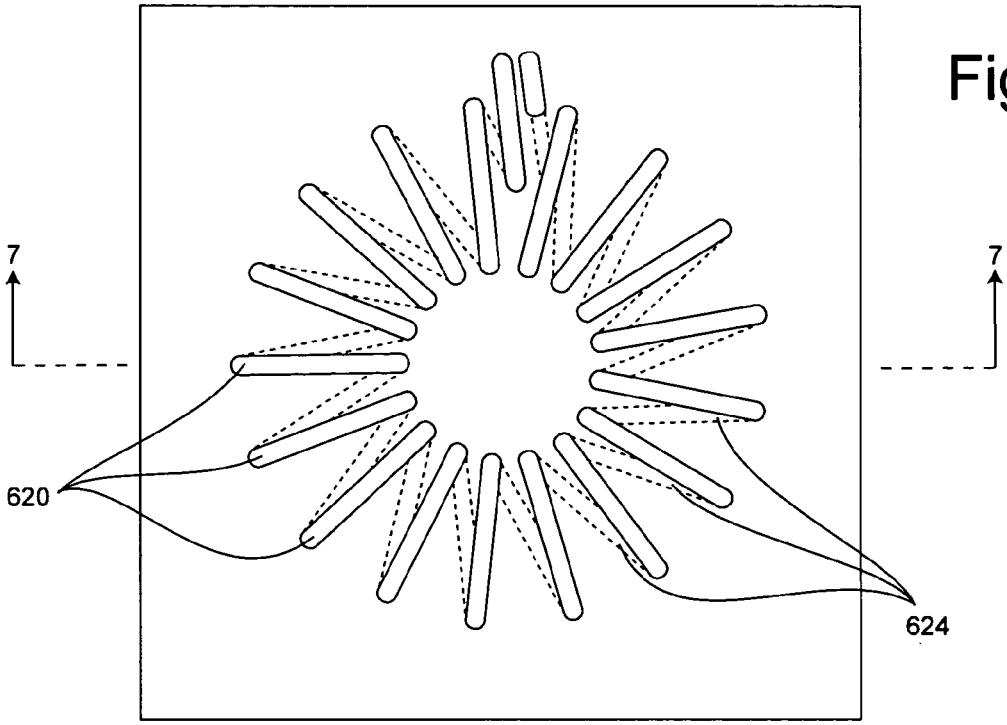
FIG. 6 is a top view of a substrate, after conductive traces and a second layer has been added to form a toroidal inductor, which is useful for understanding the present invention.
Figure 7:
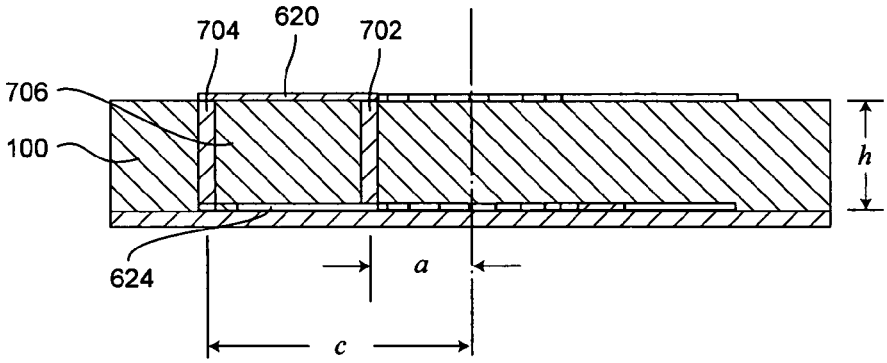
FIG. 7 is a cross-sectional view of the substrate in FIG. 6, taken along lines 7—7.

For example, referring to FIGS. 6 and 7, if the toroidal inductor only included turns defined by inner vias 702 and outer vias 704, with conductive traces 620, 624 disposed therebetween, the inductance would be given by the following equation:

$$L = \frac{\mu N_1^2 h}{2\pi} \ln \frac{c}{a} \tag{1}$$

in which μ is the permeability of the substrate 100, $N_1$ is the number of turns defined by the vias 702 and 704 and respective conductive traces 620 and 624, h is a height of the inductor (thickness of the substrate 100), a is a first radial distance shown in FIG. 7 which is equal to the first radial distance a shown in FIG. 2, and c is the second radial distance shown in FIG. 7 which is equal to the third radial distance c shown in FIG. 2.

Equation (1) assumes that each turn of the toroidal coil defines a cross sectional area 706 through a toroidal core region of the toroidal inductor which is constant. However, for the embodiment shown in FIGS. 1–4, a cross sectional area 440 defined by turns comprising vias 102 and 106 and conductive traces 320 and 324 is greater than a cross sectional area 442 defined by turns comprising vias 104 and 106 and conductive traces 322 and 326. Accordingly, equation (1) may not accurately compute the inductance of the toroidal inductor shown in FIGS. 1–4. The inductance for this embodiment can be expressed as:

$$L = \frac{\mu h}{2\pi}\left[N_1^2 \ln \frac{b}{a} + (N_1 + N_2)^2 \ln \frac{c}{b}\right] \tag{2}$$

wherein b is the second radial distance shown in FIG. 2, $N_1$ is the number of turns defined by vias 102 and 106 and conductive traces 320 and 336 and $N_2$ is the number of turns defined by vias 104 and 106 and conductive traces 322 and 336. Naturally, the inductor shown in FIGS. 1–4 and described by equation (2) will have a higher inductance than the inductor shown in FIGS. 6–7, which is described by equation (1).

The process can also include the step of providing one or more selected regions of the substrate layer 100 to have at least one electrical characteristic different from at least one other portion of the substrate layer. Exemplary processes for providing such regions are described in commonly assigned U.S. patent application Ser. No. 10/657,054 filed on Sep. 5, 2003, which is incorporated herein by reference. For example, the permeability of a toroid shaped core region 434 defined by the conductive vias and conductive traces of the toroidal coil can be selectively tailored by forming at least a portion of the core region with a material having ferromagnetic or paramagnetic properties such that the relative permeability of such material is greater than 1. As is apparent from equation (2), providing the region 434 with a relative permeability greater than 1 can result in an increased inductance of the toroidal inductor relative to a core region 434 which has a permeability equal to 1.

Any suitable means can be used to form the core region 434 to have a permeability greater than 1. For example, the substrate layer 100 can be provided as material having a desired permeability. In an alternative embodiment, the substrate 100 can be formed so that the high permeability region exclusively includes the toroidal core region 434. Examples of material can that can be used to tailor the electrical characteristics of the region 434 can include meta-materials and LTCC materials which have a relative permeability greater than one. Still, a myriad of other materials having relative permeability greater than 1 are known to those skilled in the art and the invention is not limited in this regard.

In the case of RF circuit boards, it is often desired to include one or more ground planes. For example, at least one conductive layer 436 can be disposed beneath the substrate layer 430. However, the invention is not so limited. For instance, a conductive layer (not shown) can be disposed above the substrate 100. One or more substrate layers (not shown) can insulate the conductive layer from the conductive traces 320, 322, 324, 326, 328.

Figure 8:
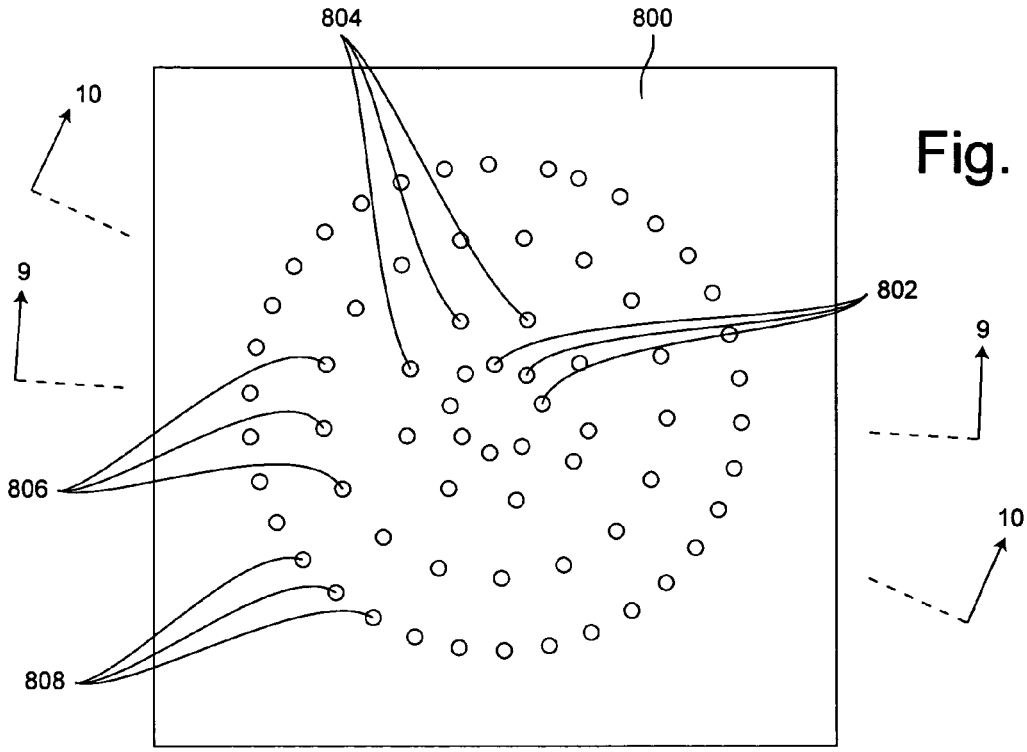
FIG. 8 is a top view of a ceramic substrate which is useful for understanding an alternative embodiment of the present invention.
Figure 9:
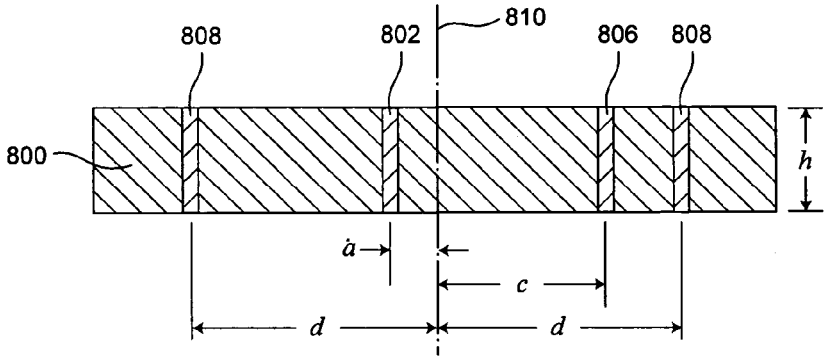
FIG. 9 is a cross-sectional view of the substrate of FIG. 8, taken along lines 9—9.
Figure 10:
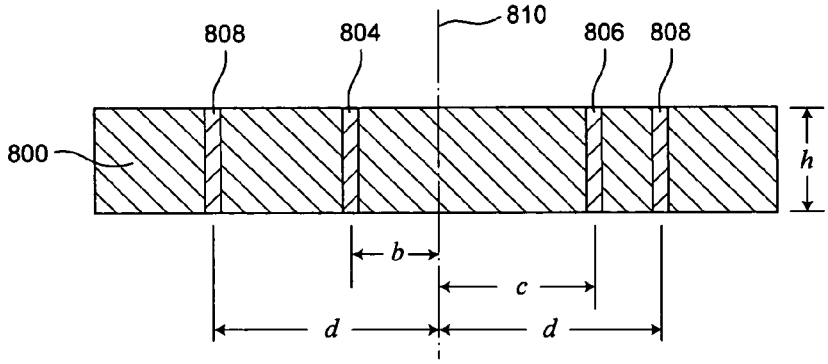
FIG. 10 is a cross-sectional view of the substrate of FIG. 8, taken along lines 10—10.

FIG. 8 depicts another embodiment of a toroidal inductor integrated within a substrate which is useful for understanding the present invention. FIG. 9 is a cross-sectional view of the substrate of FIG. 8, taken along lines 9—9, and FIG. 10 is a cross-sectional view of the substrate of FIG. 8, taken along lines 10—10. Making reference to each of FIGS. 8–10, conductive vias can be formed in the substrate layer 800 using any suitable technique. In particular, a first plurality of conductive vias 802 can be radially spaced a first radial distance a from a central axis 810 so as to define an inner circumference of a toroidal inductor. A second plurality of conductive vias 804 can be radially spaced a second distance b from the central axis 810 to define a first intermediate circumference, and a third plurality of conductive vias 806 can be radially spaced a third distance c from the central axis 810 to define a second intermediate circumference. Finally, a fourth plurality of conductive vias 808 can be radially spaced a fourth distance d from the central axis 810 to define an outer circumference.

Figure 11:
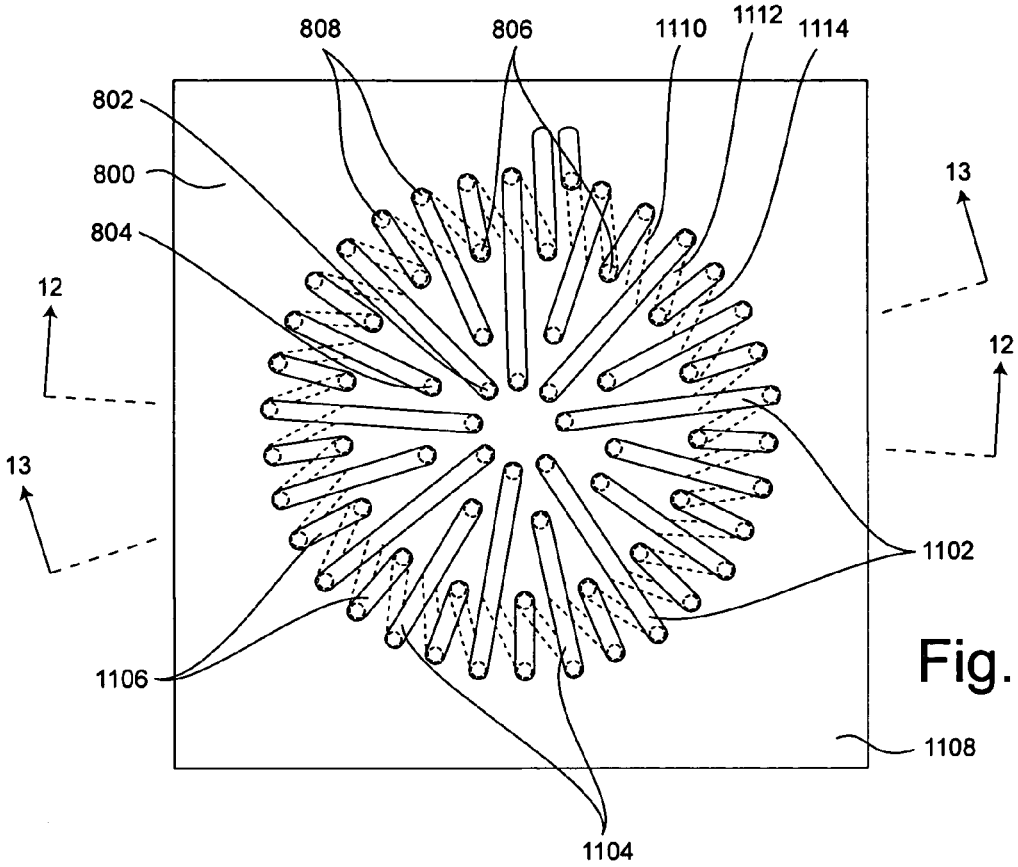
FIG. 11 is a top view of the substrate in FIG. 8, after conductive traces and a second layer has been added to form a toroidal inductor.
Figure 12:
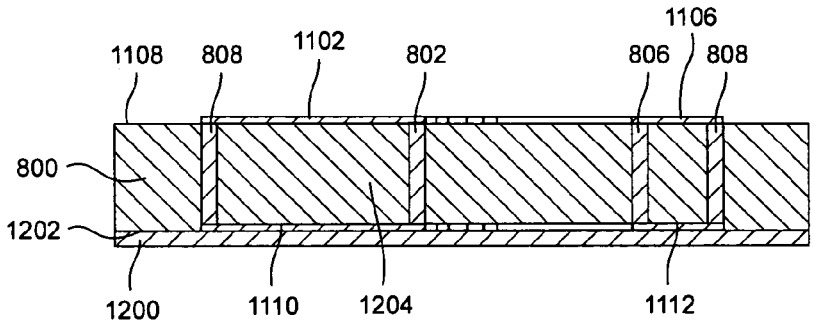
FIG. 12 is a cross-sectional view of the substrate in FIG. 11, taken along lines 12—12.
Figure 13:
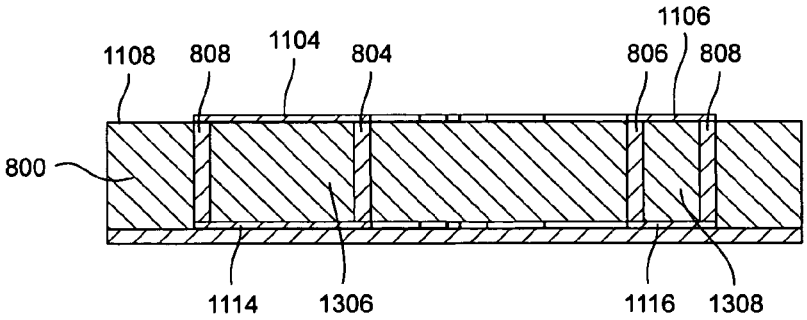
FIG. 13 is a cross-sectional view of the substrate in FIG. 11, taken along lines 13—13.

FIG. 11 is a top view of the substrate in FIG. 8, after conductive traces and a second layer have been added to form a toroidal inductor. FIG. 12 is a cross-sectional view of the substrate in FIG. 11, taken along lines 12—12, and FIG. 13 is a cross-sectional view of the substrate in FIG. 11, taken along lines 13—13. Making reference to FIGS. 11–13, a first plurality of conductive traces 1102, a second plurality of conductive traces 1104, and a third plurality of conductive traces 1106 can be disposed on the substrate layer 800. The conductive traces 1102 can be disposed on surface 1108 of the substrate layer 100 to form electrical connections between respective ones of the first plurality of conductive vias 802 and the fourth plurality of conductive vias 808 that are substantially radially adjacent. Similarly, the conductive traces 1104 on surface 1108 can form electrical connections between respective ones of the second plurality of conductive vias 804 and fourth plurality of conductive vias 808 that are substantially radially adjacent. Finally, the conductive traces 1106 on surface 1108 form electrical connections between respective ones of the third plurality of conductive vias 806 and fourth plurality of conductive vias 808 that are substantially radially adjacent.

A fourth plurality of conductive traces 1110, a fifth plurality of conductive traces 1112, a sixth plurality of conductive traces 1114 and a seventh plurality of conductive traces 1116 can be provided on surface 1202 of a second substrate layer 1200. The fourth plurality of conductive traces 1110 can be arranged so that when the two substrate layers 800, 1200 are aligned and stacked as shown, the traces 1110 on surface 1202 can provide an electrical connection between circumferentially offset ones of the first plurality of conductive vias 802 and the fourth plurality of conductive vias 808. Similarly, the traces 1112 on surface 1202 can provide an electrical connection between circumferentially offset ones of the third plurality of conductive vias 806 and the fourth plurality of conductive vias 808. The traces 1114 on surface 1202 can provide an electrical connection between circumferentially offset ones of the second plurality of conductive vias 804 and the fourth plurality of conductive vias 808.

Figure 14:
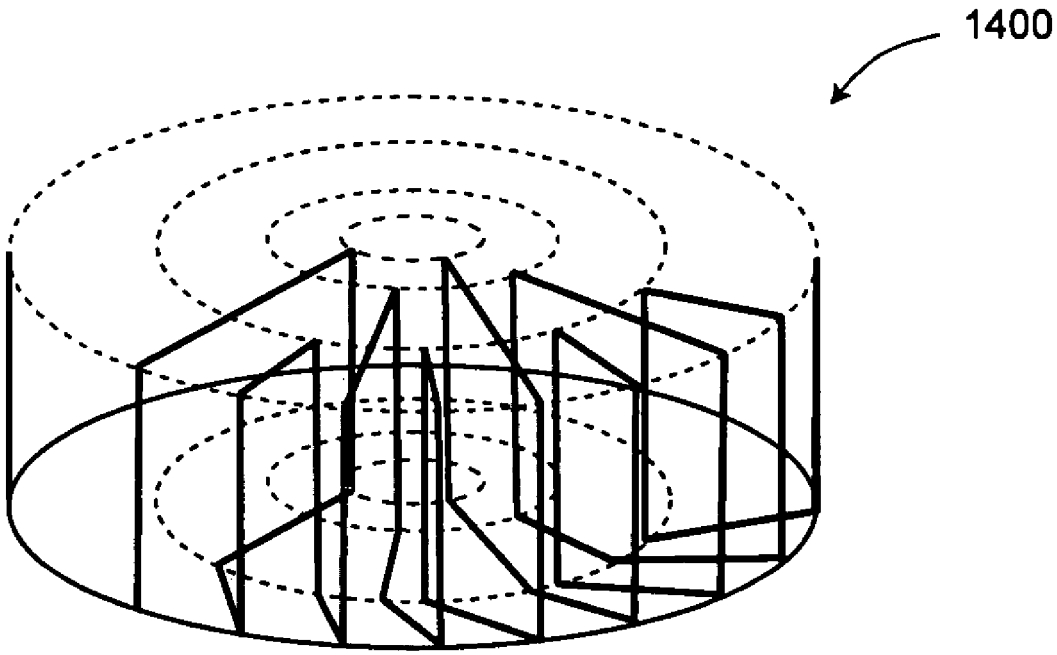
FIG. 14 is a schematic representation that is useful for understanding the structure of the toroidal inductor in FIGS. 8–12.

The schematic representation in FIG. 14 is also useful for understanding the toroidal coil structure 1400 resulting from the arrangement described relative to FIGS. 8–13. In this regard, it should be understood that the invention herein is not limited to the precise arrangement or pattern of vias and conductive traces that are illustrated in FIGS. 8–13. Instead, any pattern of vias and traces formed in the substrate layer can be used provided that it generally results in a substantially toroidal coil arrangement of the kind similar to that illustrated in FIG. 14, it being understood that many minor variations are possible.

In the embodiment shown in FIGS. 8–13, a cross sectional area 1204 defined by turns comprising vias 802 and 808 and conductive traces 1102 and 1110 is greater than a cross sectional area 1306 defined by turns comprising vias 804 and 808 and conductive traces 1104 and 1114. Similarly, the cross sectional area 1306 is greater than a cross sectional area 1308 defined by turns comprising vias 806 and 808 and conductive traces 1106 and 1112. The inductance for this embodiment can be expressed as:

$$L = \frac{\mu h}{2\pi}\left[N_1^2 \ln\frac{b}{a} + (N_1 + N_2)^2 \ln\frac{c}{b} + (N_1 + N_2 + N_3)^2 \ln\frac{d}{c}\right] \tag{3}$$

in which μ is the permeability of the substrate 800, $N_1$ is the number of turns defined by vias 802 and 808 and conductive traces 1102 and 1110, $N_2$ is the number of turns defined by vias 804 and 808 and conductive traces 1104 and 1114, $N_3$ is the number of turns defined by vias 806 and 808 and conductive traces 1106 and 1112, h is a height of the inductor (thickness of the substrate 800), a is the first radial distance shown in FIG. 9, b is the second radial distance shown in FIG. 10, c is the third radial distance shown in FIG. 10, and d is the fourth radial distance shown in FIG. 10. Again, the inductor shown in FIGS. 8–13 and described by equation (3) will have a higher inductance than the inductor shown in FIGS. 6–7, which is described by equation (1).

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims. For example, while the first embodiment discloses an embedded toroidal inductor comprising essentially two lengths of conductive traces interdigitated in a radial array fashion on a substrate surface, and the second embodiment discloses a toroidal inductor comprising essentially three lengths of interdigitated conductive traces on a substrate surface, the invention is not limited in this regard. More particularly, the toroidal coil can include any number of conductive traces having different lengths to define four or more pluralities of turns having different sized cross sectional areas. A general equation for computing the inductance of such an inductor can be expressed as follows:

$$L = \frac{\mu h}{2\pi}\left[N_1^2 \ln\frac{x_2}{x_1} + (N_1 + N_2)^2 \ln\frac{x_3}{x_2} + (N_1 + N_2 + N_3)^2 \ln\frac{x_4}{x_3} + \ldots + (N_1 + N_2 + N_3 + \ldots + N_n)^2 \ln\frac{x_{n+1}}{x_n}\right] \tag{4}$$

in which n is the number of groups of turns having different sized cross sectional areas, N is the number of turns in a respective group of turns, and x is the radial distance of respective vias defining inner and outer radii of a particular toroidal area.

We claim:

1. A method for forming an inductor, comprising:

forming in a substrate a first plurality of conductive vias radially spaced a first distance from a central axis so as to define a first inner circumference;

forming in said substrate a second plurality of conductive vias radially spaced a second distance from said central axis so as to define a second inner circumference, said second distance greater than said first distance;

forming in said substrate a third plurality of conductive vias radially spaced a third distance from said central axis so as to define an outer circumference, said third distance greater than said second distance;

forming a first plurality of conductive traces disposed in a first plane defined orthogonal to said central axis, said first plurality of conductive traces forming an electrical connection between substantially radially adjacent ones of said first and third plurality of conductive vias;

forming a second plurality of conductive traces disposed in said first plane, said second plurality of conductive traces forming an electrical connection between substantially radially adjacent ones of said second and third plurality of conductive vias;

forming a third plurality of conductive traces disposed in a second plane spaced from said first plane and defined orthogonal to said central axis to define an electrical connection between circumferentially offset ones of said first and third plurality of conductive vias;

forming a fourth plurality of conductive traces disposed in said second plane to define an electrical connection between circumferentially offset ones of said second and third plurality of conductive visa to define a three dimensional toroidal coil.

2. The method according to claim 1, further comprising co-firing said substrate and said toroidal coil to form an integral substrate structure with said toroidal coil at least partially embedded therein.

3. The method according to claim 1, further comprising forming at least a toroid shaped core region of said substrate, defined within said toroidal coil, of a material having at least one electrical characteristic different from at least one other portion of said substrate.

4. The method according to claim 3, further comprising selecting said electrical characteristic to be a permeabilty.

5. The method according to claim 3, further comprising selecting said material to be a low-temperature co-fired ceramic (LTCC) material.

6. The method according to claim 3, further comprising co-firing said substrate and said material to form an integral substrate structure.

7. The method according to claim 1, further comprising forming said substrate by stacking a plurality of substrate layers, and selecting at least one of said substrate layers to have a relative permeability greater than one.

8. The method, according to claim 7, further comprising positioning said at least one substrate layer having a relative permeability greater than one to be at least partially contained within a toroid shaped core region of said substrate, defined within said toroidal coil.

9. The method according to claim 1, further comprising:

forming in said substrate a fourth plurality of conductive vies radially spaced a fourth distance from said central axis so as to define a third inner circumference, said fourth distance less than said first distance;

forming a fifth plurality of conductive traces disposed in said first plane, said fifth plurality of conductive traces forming an electrical connection between substantially radially adjacent ones of said fourth and third plurality of conductive vias;

forming a sixth plurality of conductive traces disposed in said second plane to define an electrical connection between circumferentially offset ones of said fourth and third plurality of conductive vias.

10. An inductor, comprising:

a first plurality of conductive vias formed in a substrate and radially spaced a first distance from a central axis so as to define a first inner circumference;

a second plurality of conductive vias formed in said substrate and radially spaced a second distance from said central axis so as to define a second inner circumference, said second distance greater than said first distance;

a third plurality of conductive vias formed in said substrate and radially spaced a third distance from said central axis so as to define an outer circumference, said third distance greater than said second distance;

a first plurality of conductive traces disposed in a first plane defined orthogonal to said central axis, said first plurality of conductive traces forming an electrical connection between substantially radially adjacent ones of said first and third plurality of conductive vias;

a second plurality of conductive traces disposed in said first plane, said second plurality of conductive traces forming an electrical connection between substantially radially adjacent ones of said second and third plurality of conductive vias;

a third plurality of conductive traces disposed in a second plane spaced from said first plane and defined orthogonal to said central axis to define an electrical connection between circumferentially offset ones of said first and third plurality of conductive vias;

a fourth plurality of conductive traces disposed in said second plane to define an electrical connection between circumferentially offset ones of said second and third plurality of conductive vias to define a three dimensional toroidal coil.

11. The inductor according to claim 10, wherein said substrate, said conductive vias and said conductive traces comprise an integral substrate structure with said toroidal coil at feast partially embedded therein.

12. The inductor according to claim 10, wherein at least a toroid shaped core region of said substrate, defined within said toroidal coil, comprises a material having at least one electrical characteristic different from at least one other portion of said substrate.

13. The inductor according to claim 12, wherein said electrical characteristic is permeability.

14. The inductor according to claim 12, wherein said substrate material is a low-temperature co-fired ceramic (LTCC) material.

15. The inductor according to claim 12, wherein said material is integral with said substrate.

16. The inductor according to claim 10, wherein said substrate comprises a stack of substrate layers, and at least one of said substrate layers has a relative permeability greater than one.

17. The inductor according to claim 16, wherein at least one substrate layer having a relative permeability greater than one is at least partially contained within a toroid shaped core region of said substrate which is defined within said toroidal coil.

18. The inductor according to claim 10, further comprising:

a fourth plurality of conductive vias radially spaced a fourth distance from said central axis so as to define a third inner circumference, said fourth distance less than said first distance;

a fifth plurality of conductive traces disposed in said first plane, said fifth plurality of conductive traces forming an electrical connection between substantially radially adjacent ones of said fourth and third plurality of conductive vias;

a sixth plurality of conductive traces disposed in said second plane to define an electrical connection between circumferentially offset ones of said fourth and third plurality of conductive visa.

19. A printed circuit board, comprising:

a substrate;

a toroidal core region defined within said substrate; and a single continuous toroidal coil comprising a first plurality of turns formed about said toroidal core region and a second plurality of turns formed about said toroidal core region, said second plurality of turns defining a cross sectional area greater than a cross sectional area defined by said first plurality of turns.

20. The printed circuit board according to claim 19, wherein said substrate and said single continuous toroidal coil comprise an integral substrate structure with said single continuous toroidal coil at least partially embedded therein.

21. The printed circuit board according to claim 19, wherein said first and second plurality of turns are disposed in alternating succession.

22. The printed circuit board according to claim 19, wherein said first and second plurality of turns are contained within said substrate at all points.

23. The printed circuit board according to claim 19, wherein said toroidal core region comprises a substrate material that has a permeability greater than a second substrate material comprising at least one other portion of said substrate.

24. The printed circuit board according to claim 19, wherein said single continuous toroidal coil further comprises a third plurality of turns formed about said toroidal core region, said third plurality of turns defining a cross sectional area greater than a cross sectional area defined by said second plurality of turns.

25. A method for forming an inductor in a substrate, comprising:

forming a single continuous toroidal coil comprising a first plurality of turns about a toroidal core region defined in said substrate and a second plurality of turns about said toroidal core region, said second plurality of turns defining a cross sectional area greater than a cross sectional area defined by said first plurality of turns.

26. The method according to claim 25, further comprising co-firing said substrate and said single continuous toroidal coil to form an integral substrate structure with said single continuous toroidal coil at least partially embedded therein.

27. The method according to claim 25, further comprising disposing said first and second plurality of turns in alternating succession.

28. The method according to claim 25, further comprising forming said toroidal corn region with a substrate material to have a permeability greater than at least one other portion of said substrate.

29. The method according to claim 25, further comprising forming said single continuous toroidal coil with a third plurality of turns about said toroidal core region, said third plurality of turns defining a cross sectional area greater than said cross sectional area defined by said second plurality of turns.

30. A toroidal inductor, comprising:

a substrate;

a toroidal core region defined within said substrate; and a single continuous toroidal coil comprising a first plurality of turns formed about said toroidal core region and a second plurality of turns formed about said toroidal core region, said second plurality of turns defining a cross sectional area greater than a cross sectional area defined by said first plurality of turns.

31. The toroidal inductor according to claim 30, wherein said substrate and said single continuous toroidal coil comprise an integral substrate structure with said single continuous toroidal coil at least partially embedded therein.

32. The toroidal inductor according to claim 30, wherein said first and second plurality of turns are disposed in alternating succession.

33. The toroidal inductor according to claim 30, further wherein said toroidal core region comprises a substrate material having a permeability greater than at least one other portion of said substrate.

34. The toroidal inductor according to claim 30, further comprising a third plurality of turns formed about said toroidal core region, said third plurality of turns defining a cross sectional area greater than said cross sectional area defined by said second plurality of turns.

* * * * *

UNITED STATES PATENT AND TRADEMARK OFFICE

CERTIFICATE OF CORRECTION

PATENT NO. : 7,158,005 B2
APPLICATION NO. : 11/055154
DATED : January 2, 2007
INVENTOR(S) : Pleskach et al.

It is certified that error appears in the above-identified patent and that said Letters Patent is hereby corrected as shown below:

Column 1
Line 21, delete "permeability $\infty$" and replace with -- permeability $\mu$ --.

Signed and Sealed this

Sixth Day of November, 2007

JON W. DUDAS
*Director of the United States Patent and Trademark Office*